US006332665B1

(12) United States Patent
Mantell et al.

(10) Patent No.: US 6,332,665 B1
(45) Date of Patent: Dec. 25, 2001

(54) SKEWED SUBSTRATE PIXEL ARRAY PRINTING MACHINE

(75) Inventors: David A. Mantell; Mark D. Tracy, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/467,480

(22) Filed: Dec. 20, 1999

(51) Int. Cl.[7] ..... B41J 23/00; B41J 29/38
(52) U.S. Cl. ..... 347/37; 347/16
(58) Field of Search ..... 347/37, 105, 16

(56) References Cited

U.S. PATENT DOCUMENTS 4,849,774 7/1989 Endo et al. ..... 347/56
6,016,752 * 1/2000 Harari ..... 101/486
6,092,893 * 7/2000 Yokoi et al. ..... 347/104

* cited by examiner

*Primary Examiner*—Thinh Nguyen
(74) *Attorney, Agent, or Firm*—Tallam I. Nguti

(57) ABSTRACT

A skewed substrate pixel array printing machine includes a frame; a printhead mounted to the frame for printing pixels onto a platen; a device for providing relative motion between the printhead and a platen; and a platen for printing thereon. The platen has a platen axis parallel to a direction of the relative motion between the printhead and the platen; and a rectangular area thereon for printing onto. The rectangular area importantly has an edge thereto that forms an image defect preventing first skew angle with the platen axis.

10 Claims, 5 Drawing Sheets

SKEWED SUBSTRATE PIXEL ARRAY PRINTING MACHINE

BACKGROUND OF THE INVENTION

This invention relates generally to pixel array printing machines such as ink jet printers, and more particularly to a skewed substrate pixel array printing machine including a skewed printing area or skewed sheet supporting area, platen.

Liquid ink printers of the type frequently referred to either as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet printer, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated along a line normal to a supported recording medium to print one swath of information (equal to the length of a column of nozzles), at a time, on the supported, stationary recording medium, such as paper or a transparency.

After the swath is printed, the paper or the printhead is stepped a distance equal to the span of the printed swath or a portion thereof, so that the next printed swath is contiguous or overlapping therewith. This procedure is repeated until an entire page is printed. In contrast, the page width printer includes a stationary printhead that is mounted at right angle to the recording medium and has a length sufficient to print across the width or length of the supported recording medium at a time. The supported recording medium is continually moved past the page width printhead in a direction substantially normal to the printhead length and at a constant or varying speed during the printing process.

The trend in ink jet printer design is clearly towards higher and higher speed. Other than the number of nozzles in a printhead or the maximum firing frequency of the printhead, there are many other factors that affect the printing speed of an ink jet printer. Therefore, as print speeds are increased, the amount of printer time spent on activities, (such as properly registering an entire edge of a sheet to be printed on) other than actual printing can become a large portion of the time required by the printer for producing a page.

One of the well known designs for an ink jet printer involves transporting the printing sheet or paper on a rotatable drum platen. The advantages of printing on a drum platen, for example include inherent unidirectional printing, and the elimination of flyback time as is common in the case of an oscillating printhead mechanism on a flat non-rotating platen. The advantages also include a potential for proper image registration, since swath-to-swath or pass-to-pass sheet or paper advance errors are no longer an issue as in the case of an indexable sheet on a stationary flat platen. Typically, this architecture is used for single ejector or distributed ejectors where distances between the ejectors are many times the pixel size. In such a case the advance of the printhead is only one pixel for each rotation.

It has been found that when using an ink jet head or printhead as such, the disadvantages further include undesirably large accelerating and decelerating forces. Such forces are necessary for quickly and rapidly jump-moving, and stopping the printhead between passes or swaths, and in a registered position for printing the next swath. This of course is being done while the drum is rotating. One reason for the problem stems from the fact that the printhead must be advanced or jumped a significant fraction of its size or printing length between passes. Whereas the problem of large acceleration and deceleration forces can be avoided by using a continuously moving printhead, there are other problems including a "stair step" image defect, that are associated with printing as such in areas or substrates that are "squared to the platen", meaning areas or substrates in which the lead edge of the image is registered so that such edge is parallel to the axis of the rotating platen.

As the trend is toward larger printheads, increasing speed requires larger advances with similar required accuracies in the same amount of time. Furthermore, a gap must be left in the print region in order to accommodate this motion-degrading problem, therefore potentially eliminating any speed advantages of using a drum platen.

SUMMARY OF THE INVENTION

In accordance with the present invention, there is provided a skewed substrate pixel array printing machine includes a frame; a printhead mounted to the frame for printing pixels onto a platen; a device for providing relative motion between the printhead and a platen; and a platen for printing thereon. The platen has a platen axis parallel to a direction of the relative motion between the printhead and the platen; and a rectangular area thereon for printing onto. The rectangular area importantly has an edge thereto that forms an image defect preventing first skew angle with the platen axis.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
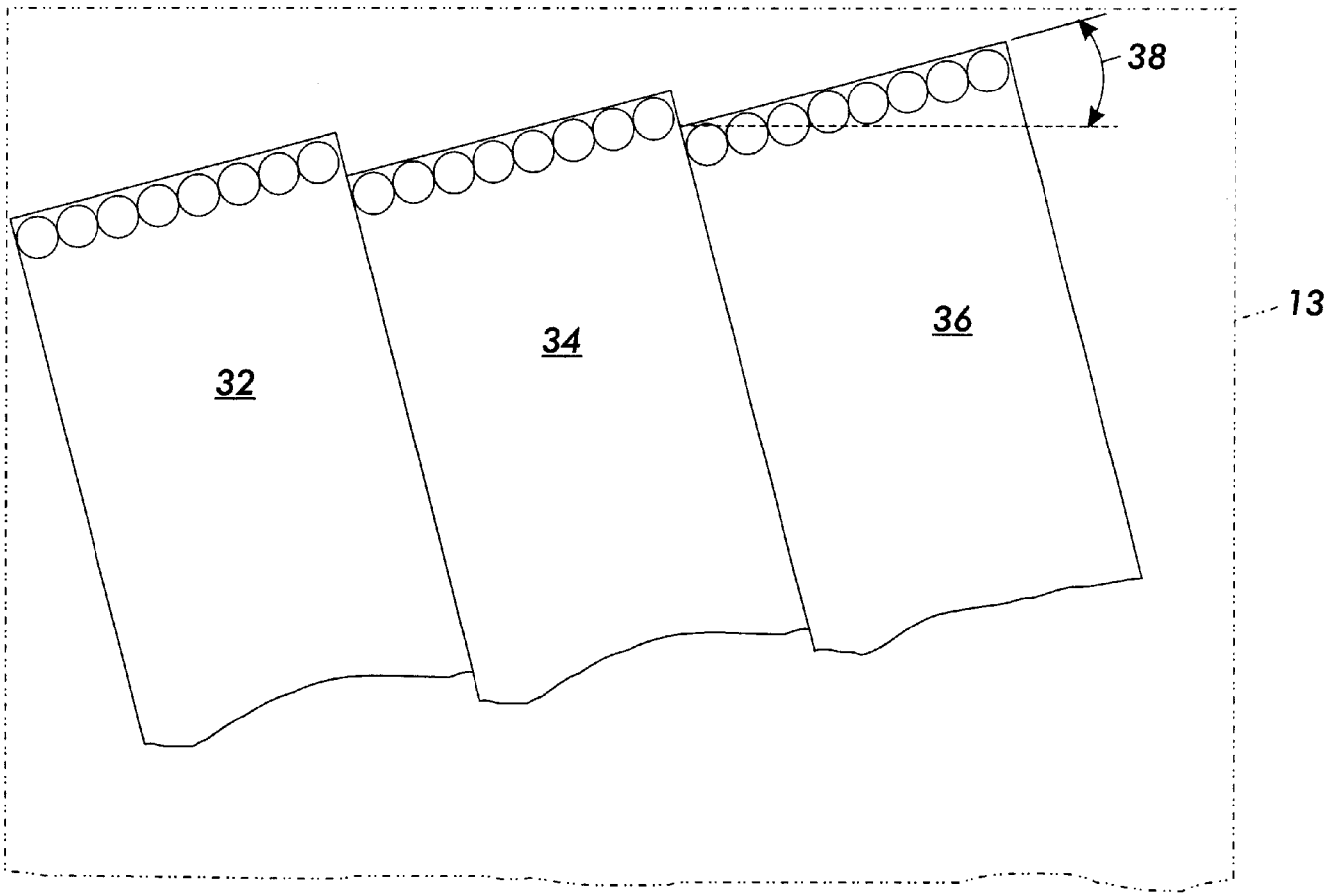
FIG. 1 is an illustration of three swaths (printed on a "squared to the platen" are n a rotating drum using a continuous moving printhead) exhibiting an undesirable "stair step" defect.

Referring first to FIG. 1, three swaths 32, 34, 36 are shown exhibiting an undesirable "stair step" defect having an undesirable skew angle 38. Swaths with such a defect, as mentioned above, are produced by a pixel array printing machine, such as an ink jet printing machine that has a rotating drum platen, a continuous moving printhead, and a "squared to the platen" printing area or sheet supporting area. As discussed above, in conventional printing machines or ink jet printers that use a rotatable drum platen, the lead edge of a printing area on the drum platen, or of a sheet being supported thereon, is ordinarily registered so that such edge is parallel to the axis of the rotating drum platen. Here, such a printing area or sheet supporting area is being described as a "squared to the platen" area.

An undesirable consequence of printing on a "squared to the platen" area is a "stair-step" image quality degrading defect. This is because drops of ink ejected by nozzles of the printhead undesirably fail to be placed precisely on a squared grid of pixel spots due to each nozzle or jet being moved a small fraction of a pixel spot each time it is addressed. This could greatly degrade the quality of either vertical or horizontal lines on the printed image by introducing whole pixel steps in the rendering of a line. The pixel steps undesirably result in the "stair step" defect pattern illustrated for example in FIG. 1. For a 300 jet 600 dpi printhead, the step in such a "stair step" defect will occur about every 20 or so pixels, which is also every pass or swath of the printhead. This occurs at a low enough frequency so as to be undesirably visible even with 600 dpi printing. Although such a defect might be acceptable for a draft mode printed image, it is ordinarily not acceptable for normal or high quality image printing.

Additionally, other problems from printing in a printing area or supported sheet that is "squared to the platen" include additional, partial printing passes. Such additional, partial printing passes are required and made at the beginning, as well as, at the end of each swath in order to print triangular wedge portions of the swaths, and page that cannot be printed due to the size and movement of the printhead.

Figure 2:
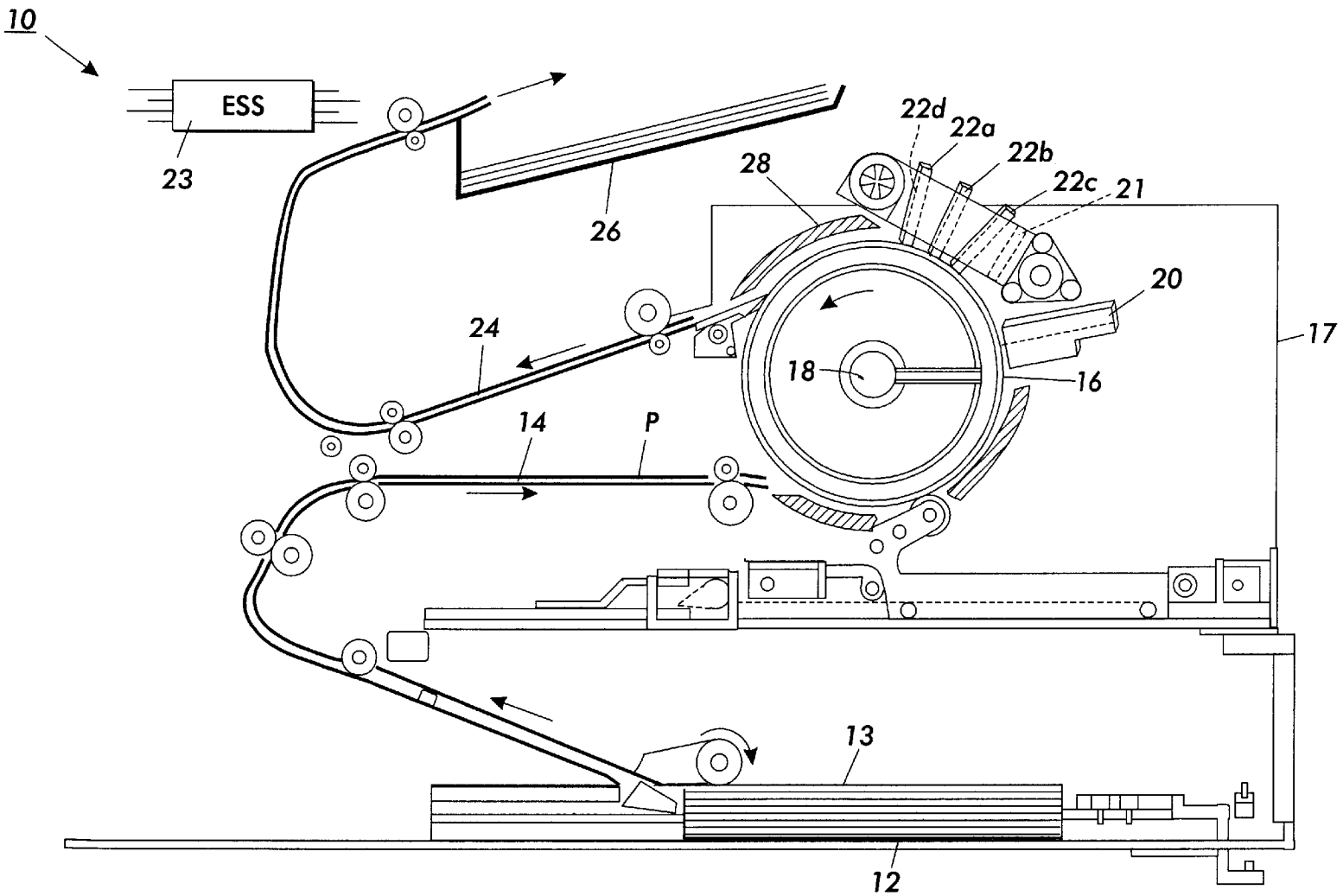
FIG. 2 is a schematic illustration of a pixel array printing machine, such as an ink jet printing machine, including a platen having a skewed image printing area, such as a skewed sheet supporting area in accordance with the present invention.

With reference now to FIG. 2, an exemplary pixel array printing machine in accordance with the present invention, such as an ink jet printer 10, is illustrated. The ink jet printer 10 is suitable for printing swaths without "stair step" defects in accordance with the present invention. As shown, the exemplary pixel array printing machine or printer 10 includes an input sheet tray 12 containing sheets 13, an input sheet path 14, a skewed printing area or skewed sheet supporting and transport, platen in the form of a rotatable drum 16 having a sheet hold down means 18. The sheet hold means 18 preferably is a vacuum source including vacuum holes 40.

Although the present invention will be described as involving printing on a sheet or substrate supported in a skewed manner on the drum platen 16, it is intended to include printing directly on the drum platen 16 in a skewed printing area on such platen 16. In which case, the image printed directly on the drum platen 16, is then subsequently transferred to a substrate that is brought into contact with the image at the same skew angle. Skewing the printing area or sheet supporting area is necessary in accordance with the present invention because merely moving the moveable printheads 22 in an ink jet printer in which the printing area or supported sheet is "squared to the platen" would require additional partial printing passes to be made at the beginning as well as at the end of each swath in order to print triangular wedge portions of the swaths and page.

As further shown, the printing machine 10 also includes a printhead arrangement comprising at least one printhead for printing ink pixels on a supported sheet 13. For example, the printhead arrangement may comprise a Full Width Array (FWA) black printhead 20, a color Partial Width Array (PWA) cluster of printheads 22 consisting of radially spaced Cyan, Yellow, Magenta and Black (CYMK) printheads (22*a*, 22*b*, 22*c*, 22*d*) located on a translatable carriage 21 as shown. As is well known, each of the printheads 20, 22 includes a linear array of nozzles for printing a swath of an array of pixels on a substrate or copy sheet 13 during a relative motion pass between the moveable printheads 22 and the platen 16.

In accordance with the present invention, each of the partial width array (PWA) printheads 22 (22*a*, 22*b*, 22*c*, 22*d*) is mounted moveably relative to the frame 17, as well as, to the length of the drum platen 16 (to be described below). As is also well known, different color ink reservoirs are provided, one respectively for each different color printhead (CYMK). The ink reservoirs are connected to the respective printheads through flexible supply lines.

Figure 3:
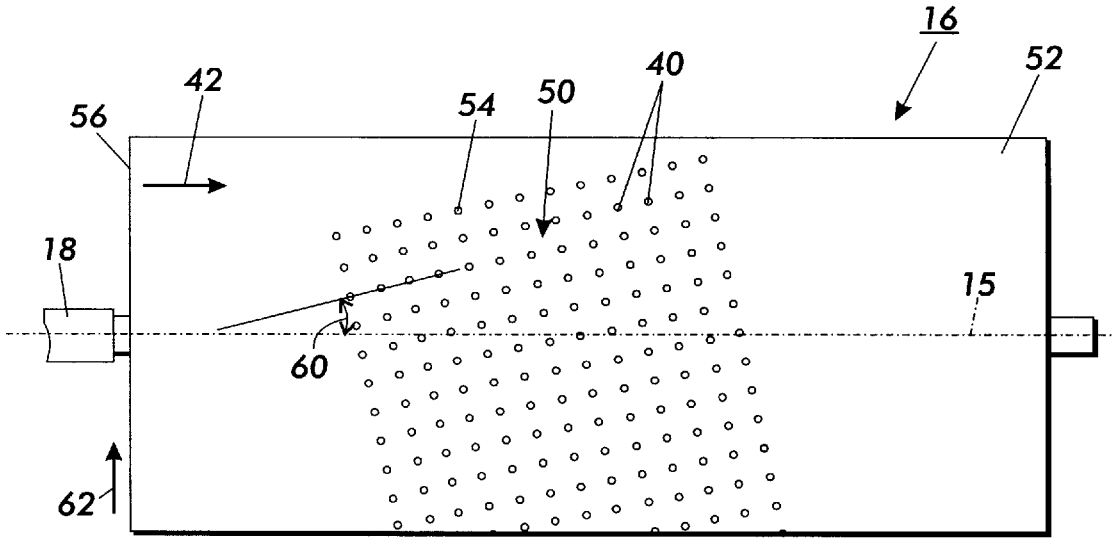
FIG. 3 is an enlarged schematic of the platen of the machine of FIG. 2 illustrating the skewed image printing area, such as a skewed sheet supporting area in accordance with the present invention.
Figure 4:
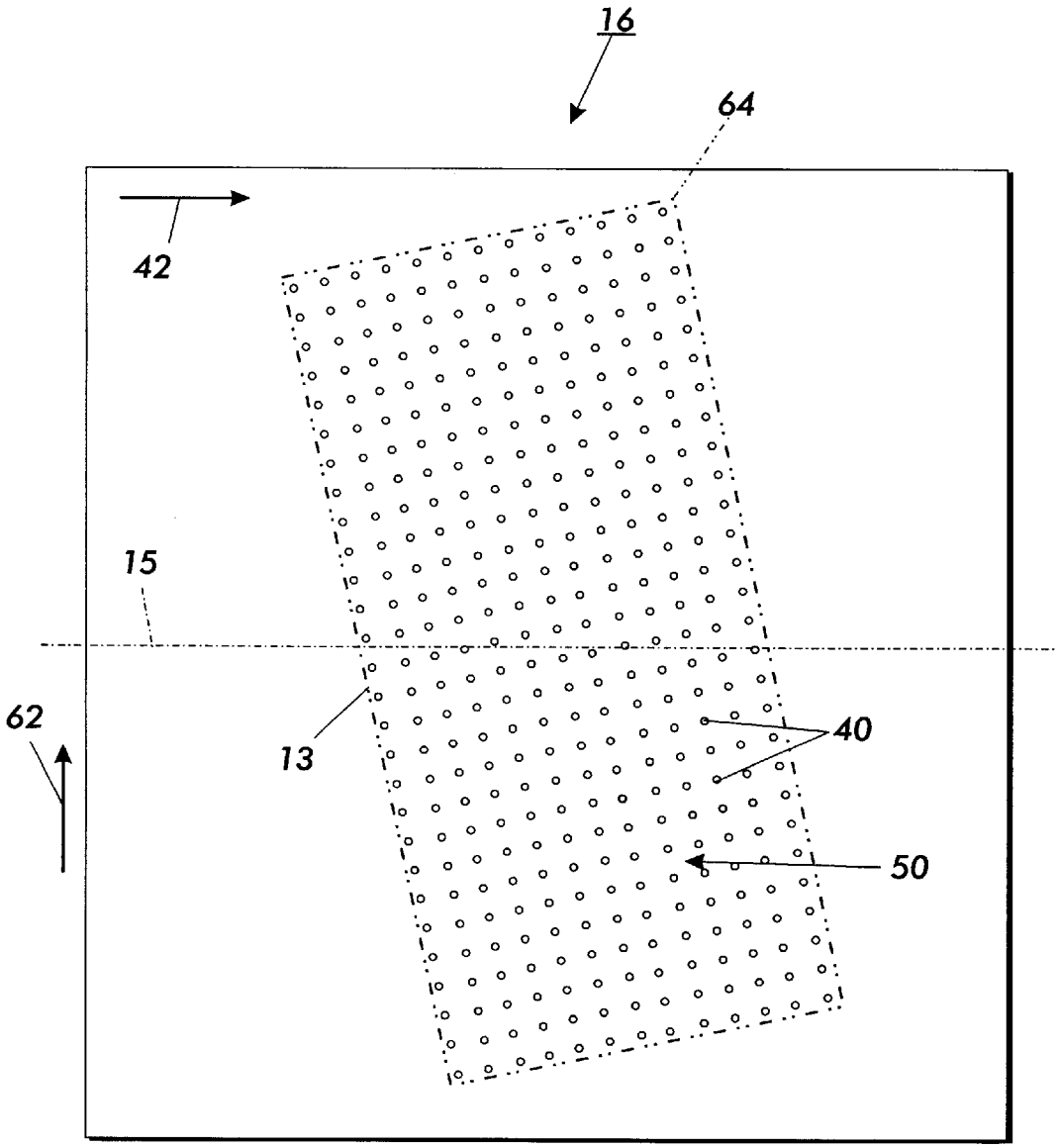
FIG 4. is the same as FIG. 3, but with the platen surface shown as a flat area.

Referring now to FIGS. 2–4, the drum platen 16 in accordance with the present invention, has a platen axis 15 that is parallel to a direction 42 of relative motion between the moveable printheads 22 (22*a*, 22*b*, 22*c*, 22*d*) and the drum platen 16. As shown, the drum platen 16 includes a rectangular area 50 thereon that can be a printing area for direct printing on the surface of the drum platen 16, or a substrate supporting area for supporting a rectangular substrate or copy sheet 13 in a properly registered orientation of sheet to the area 50. Although only one rectangular area is shown, it is understood that there equally can be more than one such rectangular area. Importantly, the rectangular area 50 includes a top edge 54 (along which the lead edge of an image printed thereon, or of the copy sheet 13 is to be registered) that forms an image defect preventing first skew angle 60 with the platen axis 15.

As described above, when printing on a copy sheet or substrate, suitable means such as a vacuum source 18 and vacuum holes 40 as shown, are provided for holding down and supporting a rectangular substrate or copy sheet 13 in registration with the rectangular area 50 on the platen 16. Importantly in accordance with the present invention, the substrate or copy sheet 13 is supported on the drum platen 16 such that its lead edge, which will be registered with a line of vacuum holes corresponding to the edge 54, forms the first skew angle 60 with any line parallel to the platen axis 15.

The first skew angle 60 preferably is chosen so as to exactly compensate for a defect angle 38 (FIG. 1) which as above is unknown to result in the "stair step" image degrading defect. As such, the first skew angle 60 will be such as to tilt the area 50 one way when the printhead is moving left to right (as shown), and to tilt the area 50 in the opposite way when the printhead is moving right to left. Usually, the circumference of the drum platen 16 is known, as well as the size or printing length "L" (FIGS. 4 and 5) and the printing mode or number of passes required for printing a single swath. In accordance with the present invention, it has been found that the first skew angle preferably should be equal to $\sin^{-1}$ of the size of the printhead divided by the circumference of the drum and by the number of passes. Different first skew angles may be used for different modes of printing in which the number of passes "n" are different.

Accordingly, it is clear that the desired or preferred first skew angle depends on the parameters of drum circumference or diameter, printhead size, and number of passes required for printing a single swath. In some cases depending on the values of the above parameters in a given printer 10, the first skew angle 60 has been found to be in the range of 0.25 to 6 degrees, and preferably is about 3 degrees. Given such angular compensation, the pixels, printed on a rotating drum in a skewed printing area by a controlled and continuously moving printhead in accordance with the present invention, become registered correctly swath-to-swath and hence to the entire the page with no stair step defect.

When printing onto a supported sheet, the sheet 13 is fed so that it is supported skewed at the first skew angle 60 relative to the platen axis 15 of the drum platen 16. To do so, the entire or whole sheet path 14 may be skewed, or a sheet skewing device (also not shown) may be provided for turning the sheet just prior to it being picked up onto the skewed sheet support area 50. Skewing the entire sheet path however has a disadvantage in that, although it is simple mechanically to build, its skew angle is not easy to vary or optimize for many print modes. In the case in which the sheet angle is adjusted into the desired skew just prior to the sheet being picked up by the drum platen, the advantage is that such technology and devices already are commonly used for the purpose of removing skew from sheets, an opposite purpose to that of the present invention which is to introduce skew into sheets as they enter the print zone.

Still referring to FIGS. 2–4, the rotatable drum platen 16 has a rotatable velocity in a direction 62 that is normal to the platen axis 15. The moveable printheads 22 (22*a*, 22*b*, 22*c*, 22*d*) as mounted moveably to the frame 17, each have a linear velocity v1 in the direction 42 that is parallel to the platen axis 15. The drum platen 16 is thus suitably equipped for being printed directly thereon at the first skew angle 60, or for precisely first receiving, registering and holding down a "lead corner" 64 of the sheet 13, followed by the entire sheet, onto the sheet supporting area 50 thereof. The supported sheet is then held thereon for transport past the printheads 20, 22.

Proper registration of the sheet 13 in accordance with the present invention is achieved by timing of the "lead corner" 64 of the sheet 13 as it reaches a corresponding lead corner supporting portion of the area 50, and then activating the vacuum source 18. Once the "lead corner" 64 of the sheet is acquired, the rest of the sheet 13 is then picked up and maintained in the same registered position on the first pass, and on any and all subsequent passes "n", until it is detached from the drum platen 16. Thus the rotatable drum 16 is used as a transport mechanism to transport the sheet past the printheads 20 and 22 as many times as necessary, depending on the printing mode, for completely printing each swath of an image, and hence each page being printed. The drum 16 may also simultaneously serve as a dryer for heating the sheet and drying the ink image as it is being printed, and prior to the sheet being fed to the output tray 26.

The printing machine 10 further includes an exit sheet path 24, a sheet output tray 26 and insulating walls 28. Both the printhead 20 and cluster of printheads 22 can be moved away from the rotatable drum platen 16 so as to allow automatic or manual maintenance, repair or adjustment of each printhead.

Figure 5:
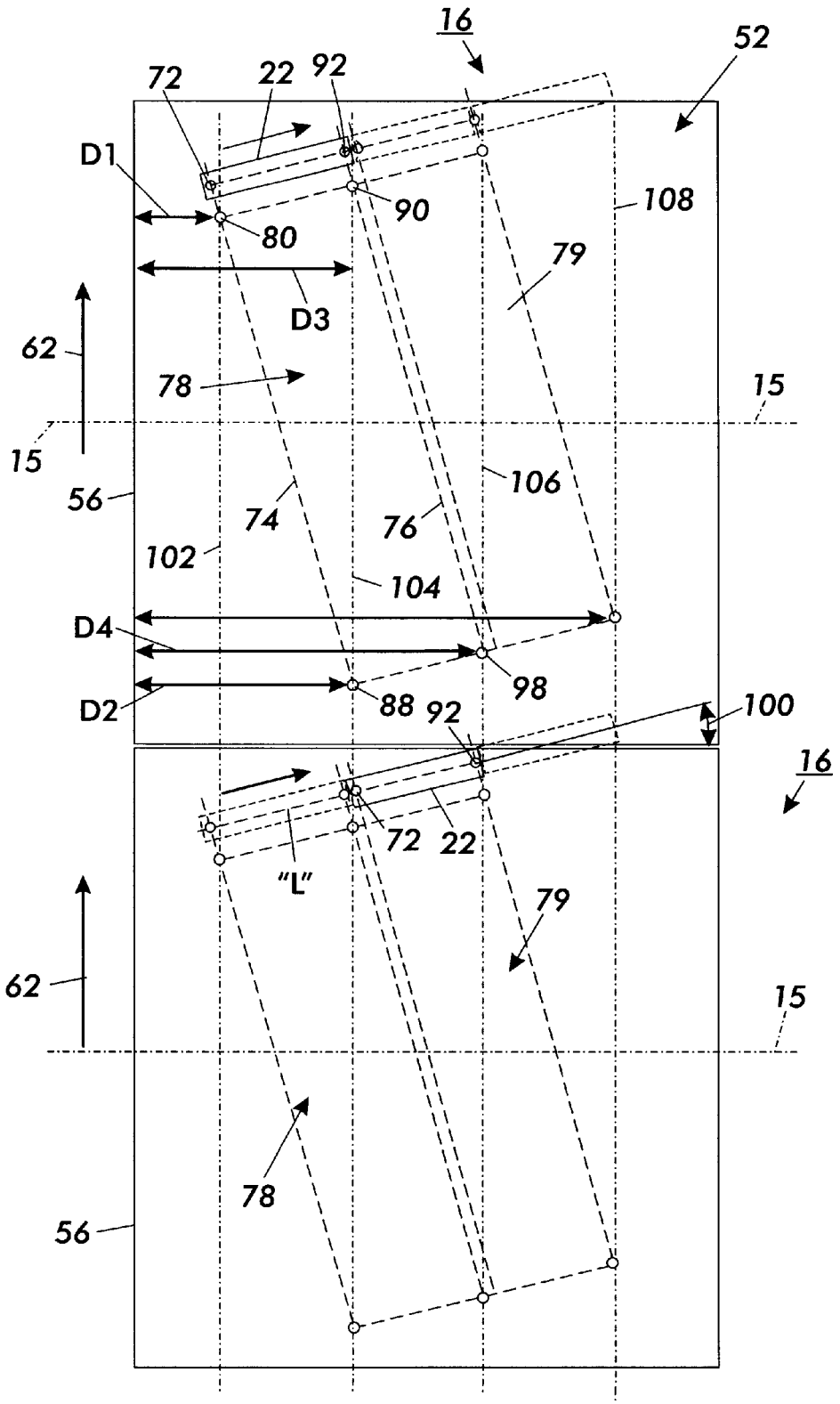
FIG 5. is an illustration of a first pass and a second pass respectively in a single pass printing mode producing two high quality printed swaths exhibiting no "stair step" defect in accordance with the present invention.

Referring in particular to FIG. 5, each printhead of the moveable printheads 22 has a size or printing length "L", and an array of nozzles including a first nozzle 72 and a last nozzle 92. The velocity or speed v1 is such that the advanced distance of each printhead, during one rotation of the drum platen 16, is one printing length "L" of the printhead. It is clear of course then that "L" is greater than one typical ejector-to-ejector spacing of the printhead. In a single pass printing mode, each nozzle of the array is aligned to print a line e.g. 74, 76 of pixels or dots that together form a swath, e.g. first swath 78 in one complete revolution of the drum platen 16, and hence in one complete pass of the moveable printheads 22 around the drum platen 16.

As shown, the drum platen 16 is rotating in the direction 62 that is parallel to the vertical lines 102, 104, 106, 108, and is normal to the platen axis 15. In accordance with the present invention, the printing area or sheet supporting area 50 (FIGS. 3–4) and sheet 13, each form a first skew angle 60, relative to the platen axis 15. As such, the top leftmost point or pixel 80 of the left margin line 74 of a first swath 78 is shown on vertical line 102, spaced a first distance D1 from the left edge 56 of the surface 52 of drum platen 16. On the other hand, the bottom leftmost point or pixel 88 of the same left margin line 74 of the first swath 78 is shown on vertical line 104, spaced a second distance D2 from the left edge 56 of the platen surface 52.

Similarly, the top rightmost point or pixel 90 of the right margin line 76 of the first swath 78 is shown on vertical line 104, spaced a third distance D3 from the left edge 56 of the platen surface 52 Whereas the bottom rightmost point or pixel 98 of the same right margin line 76 of the first swath is shown on vertical line 106, spaced a fourth distance D4 from the left edge 56. The first skew angle 60 is such that in single pass printing, the top rightmost point or pixel 90 is spaced an equal distance D2 as the bottom leftmost point or pixel 88 from the left edge 56. Hence D2 is equal to D3.

As such, the first nozzle 72 of the printhead 22 prints the first pixel 80 (top rightmost point or pixel) of the left margin 74 while itself aligned vertically on vertical line 102. Because of the controlled rotation of the platen surface 52 and controlled movement of the printhead 22, the same first nozzle will print all pixels, on the left margin 74, between the top pixel 80 and bottom pixel 88 thereof, while moving between vertical line 102 and vertical line 104. The bottom pixel 88 will then be printed while the first nozzle 72 is aligned vertically on vertical line 104.

Importantly too in accordance with the present invention, the printhead 22 is skewed at a second skew angle 100 that is equal to the first skew angle 60. As such, the last nozzle 92 of the printhead 22 will be initially aligned to print the right margin 76 of the first swath 78 when the first nozzle is aligned to print the left margin 74. Accordingly, the last nozzle 92 will print the top pixel 90 of the right margin 76 while on vertical line 104, and the bottom pixel 98 of the same right margin 76 while on the vertical line 106. In this manner, a complete swath 78, for example, can be printed in one revolution of the platen surface 52 (in a single pass printing mode) with no triangular portions or wedges to reprint. Further, a complete page consisting of several swaths, for example 78, 79, can be printed as such with no "stair step" defects.

Therefore, in accordance with the present invention, the moveable printheads 22 are moved continuously and at a controlled speed v1 during the printing of each swath 78, 79, and during printing of an entire page that consists of several swaths. Each of the moveable printheads 22 are therefore only moved across the paper once per printed page. As shown, the printheads 22 move to the right at the speed v1 that is necessary to print the lines, e.g. 74, 76, forming the swath 78. But, if one want's to print the page in two passes the advantage is that by the time the drum platen 16 comes around through a first pass for the second pass or swath 79, the moveable printheads 22 have each shifted to the right a distance equal to its entire printing length "L", so as to be properly aligned and in position for printing the second swath 79 during the second pass.

The printhead speed v1 is importantly made much less or slower than that which would be required in conventional printers for quick, rapid jump-move and stop motion as described above. Thus, the printhead speed v1 can be made slow enough so as to be compatible with accurate stepper motor controls, thereby guaranteeing quality motion control and quality drop placement during printing.

As stated above, for single pass printing in which the moveable printheads 22 print a swath only in a single pass of the drum platen 16, the printhead speed is chosen such that the printhead moves a distance equal to its nozzles span or printing length "L" in the time that it takes for the drum platen to make one complete revolution. This insures that the printing length "L" of the printhead will be entirely passed the just printed swath 78, and will be properly aligned for starting to print the next swath 79 with no gaps between swaths or passes.

For two pass printing in which the moveable printheads 22 print pixels in a swath during a first pass and reprint the same pixels during a second pass of the drum platen 16, the printhead speed would be chosen so that the printhead is moved only one-half its printing length (that is ½"L") in the time that it takes for the drum platen to make one complete revolution. In general therefore, for desired "n" pass printing in which the moveable printheads 22 print pixels in a swath during a first pass, and reprint (as necessary) each such pixel during each subsequent pass of the remaining "n−1" passes of the "n" passes of the drum platen 16, the speed of the printhead will be such as to move it a distance equal to one-$n^{th}$ (1/n) of the printhead printing length "L".

Alternately, higher order passes could be accomplished by multiples of lower numbers of passes. For example, four pass printing can be done by two two-pass print steps, with the printhead returned to the beginning between the two steps. In such a case, the first set of passes, e.g. "n"/2 passes of the entire image are printed in one right to left travel, for example, of the printhead. The printhead is then returned to the starting point at a left margin (in a left to left moving printhead), and then the next set of the "n" passes is then printed. Printing of the next set of the "n" initiated with the printhead being offset a desired number of nozzles or ejectors from the starting point of the previous printed passes, so that each pixel is printed by a different set of jets from those of the previous n passes.

As noted above, merely moving the printhead continuously while printing on a "squared-to-platen" sheet, requires additional partial swath printing passes at the beginning and the end, during which only triangular wedges are printed. Skewing the sheet 13 by supporting it at the desired first skew angle 60 in accordance with the present invention, advantageously allows for printing a whole swath per pass, and eliminates the need for additional partial swath printing passes for printing triangular wedge regions at the beginning and end of swaths. Therefore in accordance with the present invention, skewing the substrate or copy sheet and controllably moving the printheads 22 are preferred. This is because merely moving the moveable printheads 22 in an ink jet printer in which the printing area or sheet is supported "squared to the platen" with the lead edge parallel to the axis of the drum platen would require additional partial printing passes at the beginning as well as at the end of each swath in order to print triangular wedge portions of the swaths and page.

Further in accordance with the present invention as shown, it is important that the moveable printheads 22 are also mounted so that they each have the second skew angle or tilt 100 relative to the platen axis 15 of the drum platen 16. Preferably the second skew angle 100 is further adjustable as desired. As shown, the second skew angle 100 of the moveable printheads 22 are preferably equal to the first skew angle 60 of the printing area or sheet supporting area 50, and hence therefore of the sheet 13, relative to the platen axis 15.

According to the present invention, continuously and controllably moving the moveable printheads 22, as well as, feeding the sheet at the desired first skew angle 60, advantageously solves at least three critical problems faced when using a partial width array ink jet moveable printheads 22 on a rotating drum platen 16. As pointed out above, first, when the moveable printheads 22 are moved continuously while printing swaths 78, 79 across the page rather than making it "jump-move rapidly" between swaths, it improves swath-to-swath registration.

Secondly, the skewing of the printing area or supported substrate prevents the "stair-step" image quality defect or degradations as described above. Thirdly, when printing on sheets, additional image skew defects are eliminated because it is easier and far more accurate for the printer to pick up and register one small "lead corner" of a sheet onto the drum platen 16, rather than trying to similarly pick up and register an entire "lead edge" (that includes two such corners and the entire span in between them). It is clear that registration errors or misalignment will be more prevalent when attempting to pick up and register an entire lead edge. This could be caused by conditions as simple as the flatness of the edge as it enters the pickup zone. It is believed that grabbing only one corner for registration and wrapping of the sheet around the drum platen thereafter is far more reliable.

As can be seen, there has been provided a skewed substrate pixel array printing machine includes a frame; a printhead mounted to the frame for printing pixels onto a platen; a device for providing relative motion between the printhead and a platen; and a platen for printing thereon. The platen has a platen axis parallel to a direction of the relative motion between the printhead and the platen; and a rectangular area thereon for printing onto. The rectangular area importantly has an edge thereto that forms an image defect preventing first skew angle with the platen axis.

While the embodiment of the present invention disclosed herein is preferred, it will be appreciated from this teaching that various alternative, modifications, variations or improvements therein may be made by those skilled in the art, which are intended to be encompassed by the following claims.

What is claimed is:

1. A printing machine comprising:

(a) a frame;

(b) a printhead mounted to said frame for printing pixels onto a platen;

(c) means for providing relative motion between said printhead and a platen; and (d) a platen for printing thereon, said platen having;

(i) a platen axis parallel to a direction of said relative motion between said printhead and said platen; and (ii) a rectangular area thereon for printing thereon, said rectangular area having an edge thereto forming an image defect preventing first skew angle with said platen axis, wherein said platen is a rotatable drum member and said rectangular area comprises a substrate supporting area for supporting a rectangular substrate in registration with said rectangular area, and a value for said image defect preventing first skew angle depends on a diameter of said rotatable drum member, on a size of said printhead, and on a number of passes of said rotatable drum member for printing a complete swath.

2. The printing machine of claim 1, wherein said printhead includes a linear array of nozzles for printing a swath of an array of pixels onto said platen during a relative motion pass between said printhead and said platen.

3. The printing machine of claim 2, wherein said printhead is mounted such that said linear array of nozzles forms a second skew angle with said platen axis.

4. The printing machine of claim 1, wherein said printhead is mounted moveably relative to said frame.

5. The printing machine of claim 1, wherein said platen is a rotatable drum member and said image defect preventing first skew angle is has a value equal to $\sin^{-1}$ of a size of said printhead divided by a circumference of said rotatable drum member and by a number of passes of said rotatable drum member for printing a complete swath.

6. The printing machine of claim 1, wherein said drum member has a rotatable velocity in a direction normal to said platen axis and said printhead is mounted moveably to said frame and has a linear velocity parallel to said platen axis.

7. The printing machine of claim 6, wherein said linear velocity of said printhead is 1/n to print a swath of an array of pixels completely in "n" passes of said rotatable drum member.

8. The printing machine of claim 6, wherein said linear velocity of said printhead is controlled to move said printhead a distance equal to one full width of a printed swath in one revolution of said rotatable drum member.

9. The printing machine of claim 6, wherein said linear velocity of said printhead is controlled to move said printhead a distance "L" that is greater than one ejector-to-ejector spacing of said printhead, in one revolution of said rotatable drum member.

10. The printing machine of claim 1, wherein said image defect preventing first skew angle is in a range of 0.25 to 6 degrees.

* * * * *